US005772537A

United States Patent [19]

Anderson et al.

[11] Patent Number: 5,772,537

[45] Date of Patent: Jun. 30, 1998

[54] DEVICE FOR RETURNING A BALL AT A USER DETERMINABLE SPEED

[75] Inventors: Ronald A. Anderson, Seattle; Matthew P. Veeder, Stanwood, both of Wash.

[73] Assignee: Happy Day Sports Company, Seattle, Wash.

[21] Appl. No.: 873,842

[22] Filed: Jun. 12, 1997

Related U.S. Application Data

[63] Continuation-in-part of Ser. No. 795,346, Feb. 4, 1997, abandoned, and Ser. No. 794,863, Feb. 5, 1997, abandoned.

[51] Int. Cl.[6] ..... A63B 69/00

[52] U.S. Cl. ..... 473/435; 273/396

[58] Field of Search ..... 473/431, 434, 473/435, 197; 273/394, 395, 396

[56] References Cited

U.S. PATENT DOCUMENTS

| | | | |
|---|---|---|---|
| 2,944,816 | 7/1960 | Dixon | 473/435 |
| 3,427,026 | 2/1969 | Mahoney | 473/435 |
| 3,672,672 | 6/1972 | Rubin | 473/435 |
| 3,711,092 | 1/1973 | Hogue | 473/435 |
| 3,752,476 | 8/1973 | Mahoney | 473/435 |
| 3,836,144 | 9/1974 | Mahoney | 473/435 |
| 4,148,555 | 4/1979 | Lerman | 473/435 |
| 4,489,941 | 12/1984 | Shieh | 473/197 |
| 4,553,751 | 11/1985 | Ketchum | 473/435 |

*Primary Examiner*—William H. Grieb
*Attorney, Agent, or Firm*—Ronald M. Anderson

[57] ABSTRACT

A ball return device that enables a user to quickly and easily adjust the force with which a ball thrown into the device is returned. The ball return device includes a frame constructed from sections of plastic tubing joined by 90° elbows, forming a base and an elevatable portion. The elevatable portion of the frame is pivotally mounted to the base and adjustably positioned at a desired angle relative to the generally horizontal base by a pair of support members. The angle of the elevatable portion of the frame to the base determines the direction in which the ball is returned relative to a given incident path. The support members extend between the base and the elevatable portion of the frame, and each includes a smaller diameter tube slidably fitted into a larger diameter tube and selectively fixed at one a plurality of preset lengths by a pin that passes through orifices formed in the two tubes. In one preferred form of the invention, a net having hexagonal openings is suspended within the elevatable portion of the frame by lengths of an elastomeric cord that connect a periphery of the net to the frame. The hexagonal openings deform around a ball impacting the net in such a way as to ensure that the ball is consistently returned at a predictable angle relative to the angle at which the ball impacts the net. The elastomeric cord can be tightened or loosened to adjust the tension of the net, thereby determining the relative force with which a ball impacting the net is returned. A friction clip attached to the elastomeric cord retains the selected tension.

25 Claims, 5 Drawing Sheets

DEVICE FOR RETURNING A BALL AT A USER DETERMINABLE SPEED

RELATED APPLICATION

This application is a continuation-in-part patent application, based on prior applications, Ser, No. 08/795,346, filed on Feb. 4, 1997, now abandoned, and Ser. No. 08/794,863, filed on Feb. 5, 1997, now abandoned, the benefit of the filing dates of which is hereby claimed under 35 U.S.C. § 120.

FIELD OF THE INVENTION

The present invention generally relates to a device having an elastomeric panel that deflects when struck by a ball and returns the ball, and more specifically, to a frame that includes a net panel for returning the ball.

BACKGROUND OF THE INVENTION

A conventional ball return device typically includes a net stretched within a frame that is supported at a fixed angle. There is no convenient mechanism for adjusting the velocity of a ball returned from such a device. Thus, for a constant impact velocity, each returned ball will have the same velocity. While it is true that the speed of a returned ball will normally be proportional to the speed with which a ball is thrown at a conventional ball return device, the user cannot readily adjust the tension of the net in the device to vary the relationship between the incident velocity (i.e., the velocity of the ball when thrown) and the return velocity of the ball as it rebounds from the device. Because the "bounce back" characteristics of ball return devices are relatively fixed, the suitability of such devices for users of varying skill levels and the ability of such devices to provide a range of enjoyable levels of play are limited.

A ball return device with only one tension setting may be acceptable for practice by users at one level of skill, but wholly unacceptable for practice by others of substantially different skill. For example, a ball return device that has a loose, nonadjustable return tension level appropriately set for an eight-year-old child or a beginning ball player would most likely be wholly unacceptable to a major league ball player. On the other hand, a ball return device that has a tight nonadjustable return tension level appropriate for practice by a major league ball player may prove too dangerous for use by a child or a beginning ball player. An inexperienced ball player can easily be hurt by a fast return ball, particularly if the user is standing too close to the ball return device.

Various forms of frames are used for conventional ball return devices. However, none of these frames are designed to allow a user to selectively adjust the angle of the frame to ensure consistent ball returns at a desired angle. To enable a user to select the angle at which a ball is consistently returned by a ball return device, the frame of the device should be adjustable to preset angles relative to the horizontal or vertical planes. For example, if a ball return device with an adjustable frame is set at an acute angle relative to the horizontal plane (i.e., with the top of the frame closer to the user than the bottom), the ball return device will return ground balls. If the frame is adjusted so that the angle is obtuse (i.e., with the top edge farther from the user than the bottom edge of the frame), fly balls will be returned from the device. If the frame is set nearly perpendicular to the horizontal plane, but at a slight obtuse preset angle (i.e., with the top of the frame slightly angled away from the thrower), a line drive will be returned from the device.

Thus, there is clearly a need for a ball return device that will allow an individual to easily adjust the tension of the device and thus vary the speed with which a ball is returned so that practice appropriate for that individual's level of skill is attained. Moreover, there is a need for a ball return device that will allow an individual to easily adjust the angle at which a ball will be consistently returned to the user. Apparently, none of the prior art devices include these features.

SUMMARY OF THE INVENTION

In accord with the present invention, apparatus are defined for deflecting a sports projectile that is traveling along an incident path, back along a return path. The apparatus includes a frame having a base portion and an elevatable portion. An elastomeric panel is suspended within the elevatable portion by an elastomeric cord that extends between a periphery of the elastomeric panel and the elevatable portion of the frame. The elastomeric cord couples the elastomeric panel to the elevatable portion of the frame so that the elastomeric panel defines an impact area for the sports projectile as the projectile travels along the incident path. Means are provided for adjusting a tension of the elastomeric panel to enable a user to selectively change a force with which the sports projectile is deflected back along the return path relative to that at which the sports projectile traveling along the incident path strikes the elastomeric panel.

The elastomeric panel preferably comprises a net having a plurality of hexagonal-shaped openings formed of knitted strands. These hexagonal openings conform uniformly around the sports projectile when the net is impacted by the sports projectile so that the return path of the sports projectile is consistently predictable relative to its incident path.

The frame preferably comprises a plurality of tubing sections, at least some of which are joined by elbow connectors; the elevatable portion of the frame has a generally quadrilateral shape. The tubing sections comprising the elevatable portion preferably include an orifice into which a tag end of the elastomeric cord is inserted to hide any excess length of the elastomeric cord.

The elevatable portion of the frame is pivotally attached to the base portion and is selectively adjustable by the user by pivoting the elevatable portion of the frame to a desired angle relative to the base portion. In the preferred embodiment, the frame includes a support member that extends between the elevatable portion and the base portion and has a length that is adjustable. The angle of the elevatable portion relative to the base portion is thus selectively varied as a function of the length of the support member. The support member also preferably comprises a smaller diameter tube and a larger diameter tube. The smaller diameter tube slides inside the larger diameter tube, and a pin extends through an orifice in at least one of the smaller and larger diameter tubes, to adjustably fix the length of the support member.

A top of the elevatable portion of the frame can thus be set at a plurality of predefined angles relative to a horizontal plane. The plurality of predefined angles range between a first angle in which the top is closer to the user than a bottom of the elevatable portion of the frame, and a second angle in which the bottom of the elevatable portion of the frame is closer to the user than the top.

In one form of the invention, the elevatable portion of the frame includes a plurality of orifices through which the elastomeric cord is threaded to couple the elastomeric cord to the elevatable portion of the frame. The means for adjusting the tension of the elastomeric panel comprise means for selectively changing a tension in the elastomeric cord. More specifically, increasing the tension in the elastomeric cord used to couple the elastomeric panel to the elevatable portion of the frame increases the tension of the elastomeric panel. A clip is releasably attached to the elastomeric cord to maintain the cord at a desired tension.

In another embodiment, the elevatable portion of the frame includes a plurality of eyelets attached to the frame at spaced-apart intervals. The elastomeric cord is then threaded through the plurality of eyelets to couple the elastomeric panel to the elevatable portion of the frame.

In a still further alternative embodiment, the elastomeric cord is repetitively looped around the elevatable portion of the frame to couple the elastomeric panel to the frame. The elastomeric cord is drawn tight under tension and at least one end of the elastomeric cord is fastened in a clip to apply a desired tension to the elastomeric panel. In each embodiment, the frame preferably comprises a plurality of tubular sections joined by a plurality of elbows.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENTS

Figure 1:
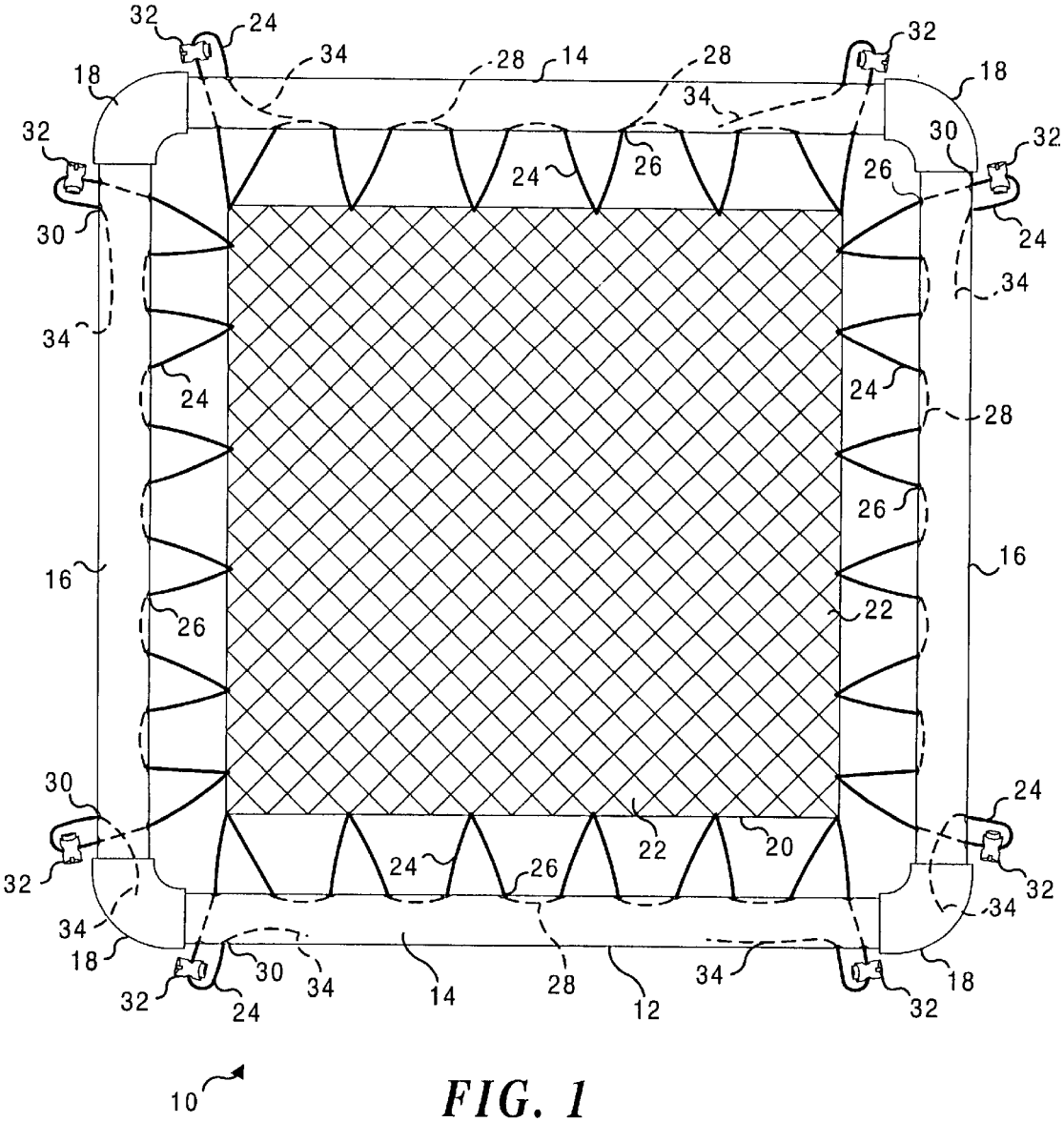
FIG. 1 is an elevational front view of a first embodiment of a ball deflecting panel in accord with the present invention.

Referring first to FIG. 1, a first embodiment of a ball deflecting panel 10 is illustrated that includes a frame 12. Frame 12 is assembled using two horizontal tubes 14, which are of equal length, for the top and bottom of the frame and two vertical tubes 16, also of equal length for the left and right sides of the frame. These tubes arc preferably formed from sections of polyvinyl chloride (PVC) tubing having a diameter of 1½ inches or more. Ends of horizontal tubes 14 are joined to ends of vertical tubes 16 with 90° elbows 18, which are sized to receive the vertical and horizontal tubes in a close friction fit.

While it is contemplated that frame 12 can be permanently assembled by adhesively coupling horizontal tubes 14 and vertical tubes 16 to 90° elbows 18, it preferable to simply rely upon the friction between the exterior surface of the horizontal and vertical tubes against the interior surface of 90° elbows 18 to retain frame 12 in an assembled configuration, thereby enabling the frame to be readily disassembled for transport or storage. In addition to the friction between the tube components of frame 12, forces are also exerted on frame 12 by the other components of ball deflecting panel 10 that tend to maintain the frame in its assembled state.

In ball deflecting panel 10, a net 20 having square/diamond-shaped openings 22 is supported within the interior of frame 12 by strands of elastomeric cord 24. This cord, which is commonly referred to as "bungy cord," is approximately 3/16" in diameter in the preferred embodiment, and comprises a core of elastomeric strands (e.g., rubber or latex fibers) covered by a woven elastomeric nylon sheath. Details of the construction of the elastomeric cord are not shown, since such cord is readily available from commercial sources such as PK Supply, Inc. in Seattle, Wash. Other sizes and types of elastomeric cord can alternatively be used for this purpose.

In the embodiment shown in FIG. 1, elastomeric cord 24 is divided into approximately four equal lengths, each being used to couple a different one of the four sides of net 20 to frame 12. The elastomeric cord is threaded through a plurality of orifices 26 that are disposed along the inwardly facing sides of horizontal tubes 14 and vertical tubes 16 at spaced-apart intervals. The elastomeric cord is passed through openings 22 adjacent the perimeter of net 20 and then back through orifices 26, forming internal runs 28 of the elastomeric cord along the interior of horizontal tubes 14 and vertical tubes 16, between adjacent orifices 26. The elastomeric tubing passes from the interior of one of these tubes through the next orifice 26 and loops through a different opening 22 of net 20, passing back into the interior of the tube through another of the orifices 26. Each side of net 20 is thus supported inside frame 12 by the four segments of elastomeric cord 24.

The outwardly facing surfaces of horizontal tubes 14 and vertical tubes 16 include two additional orifices disposed adjacent to each end, in the portion of the tubes adjacent to 90° elbows 18. The tag ends of elastomeric cord 24 pass through orifices 26 on the interior adjacent elbows 18 and outwardly through orifices 30. A friction clip 32 is slipped over the tag end of the elastomeric cords and released to clamp the elastomeric cord after a desired tension has been achieved. The friction clip grips the elastomeric cord, preventing it from pulling back into orifice 30, thereby retaining the tension to which it is adjusted.

A number of different types of friction clips are usable for this purpose.

One preferred friction clip includes a movable clamp that is urged to grip the elastomeric cord by a helical spring. When a push button end of the clamp is pressed to a released position, detents formed on the lower end of the clamp engage slots in the friction clip housing, locking the clamp in the open state, so that it slides freely along the elastomeric cord that passes through an orifice in the center of the friction clip housing. Two tabs are depressed to release the clamp, enabling the spring force to again be applied by the clamp sufficient to hold the friction clip at a desired location on elastomeric cord 24.

It will be apparent that the tension of elastomeric cord 24 can be adjusted by manually pulling the tag ends of elastomeric cord 24 outwardly of the frame through orifices 30 to increase the tension that it applies to net 20. The loops of the elastomeric cord that extend between openings 22 in the net and orifices 26 are adjusted to equalize the tension along each edge of net 20 after increasing or decreasing the tension applied by elastomeric cord 24. In this way, the user can control the tension of net 20 and thereby determine the force with which a ball or other type of sports projectile impacting the net is deflected back along a return path. For a child or a relatively inexperienced player who is throwing or hitting a ball at ball deflecting panel 10, the tension in elastomeric cord 24 and corresponding tension of net 20 would be adjusted so that it is substantially less than the tension that would be appropriate for someone of greater skill and/or age.

Once the desired tension in net 20 is achieved, friction clips 32 retain the elastomeric cord in place, maintaining the tension in the net at that level. To improve the appearance of the ball deflecting panel, tag ends 34 of the elastomeric cord are inserted into the second orifice 30 disposed at each end of the horizontal and vertical tubes.

Figure 2:
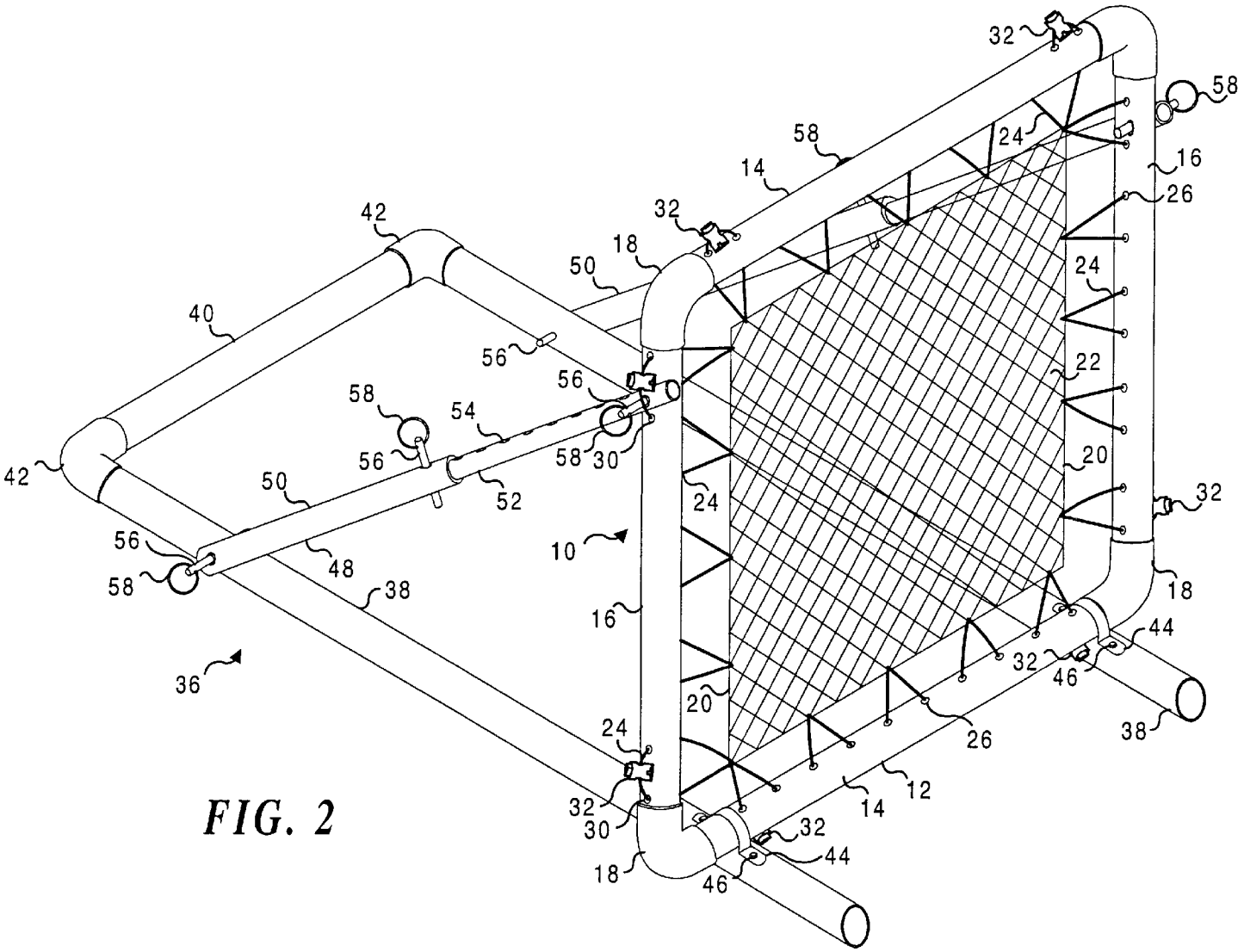
FIG. 2 is an isometric view of the first embodiment of the ball deflecting panel shown in FIG. 1, pivotally mounted on a first embodiment of a base.

In FIG. 2, ball deflecting panel 10 is shown pivotally attached to a base 36. This first preferred embodiment of base 36 is generally U-shaped and 35 includes two side tubes 38 coupled to an end tube 40 using two 90° elbows 42.

As noted above, 90° elbows 42 can be retained coupled to side tubes 38 by friction, or alternatively, can be adhesively secured to side tubes 38. PVC tubing is also used for base 36 in the preferred embodiment, so that an appropriate PVC adhesive can be used to permanently connect side tubes 38 and end tube 40 to 90° elbows 42. However, it is generally preferable to enable base 38 to be disassembled for transport or storage; the friction between the outer surfaces of side tubes 38 and end tube 40 and the interior surface of 90° elbows 42 is sufficient to maintain base 36 in an assembled state.

Ball deflecting panel 10 is pivotally attached to side tubes 38 using U-shaped clamps 44 that are attached on the top surface of side tubes 38 using lag bolts 46 or other appropriate fasteners. Clamps 44 extend over bottom horizontal tube 14 and hold it in place against the top surface of side tubes 38, enabling ball deflecting panel 10 to pivot relative to base 36 within clamps 44.

When using the present invention, it is generally desirable to set ball deflecting panel 10 at one of a plurality of different predetermined angles relative to base 36 so that the return path of the ball or other sports projectile that is deflected by net 10 is in a desired direction relative to a given angle of incidence. For example, if the top of ball deflecting panel 10 is set further away from the user than the bottom of the ball deflecting panel, a ball traveling in a generally horizontal direction when striking net 20 will typically be deflected upwardly, producing fly balls. Conversely, if the top of the ball deflecting panel is adjusted so that it is closer to the user than the bottom, a ball traveling generally horizontal when striking net 20 will be deflected downwardly, producing a ground ball. Typically, the angle of incidence of a ball or other sports projectile with net 20 will typically be equal to the angle of reflection, enabling the user to establish the desired angle of ball deflecting panel 10 relative to the horizontal or vertical plane.

To adjust the angle of ball deflecting panel 10 to achieve the desired results as noted above, two adjustable supports 48 are provided at each side of the ball deflecting panel. Supports 48 extend from a point at each side of the ball deflecting panel, near its top, downwardly to points along the outer sides of side tubes 38. Adjustable supports 48 each include an outer tube 50 and a telescoping inner tube 52 having a diameter sized to slide freely within the interior of outer tube 50. A plurality of spaced-apart orifices 54 are disposed along the top and bottom (not shown) surfaces of telescoping inner tubes 52. Orifices 54 enable a pin 56 to be inserted through orifices in outer tube 50, passing through a selected one of the orifices 54 to lock inner telescoping tube 52 at a given position relative to outer tube 50. Thus, a user can readily adjust the length of adjustable support 48 and thereby control the angle of ball deflecting panel 10 relative to base 36. A ring 58 is provided on the outer end of pin 56 to enable a user to readily pull the pin from inside orifices 54 so that the adjustable support can be set to a different length to vary the angle of ball deflecting panel 10 relative to base 36 as desired. Pins 56 with rings 58 are also used to couple the lower end of the adjustable support to side tubes 38 and the upper end of the adjustable supports to vertical tubes 16. Alternatively, threaded bolts and wing nuts or other types of fasteners can be used in place of pins 56 to couple adjustable supports 48 to the ball deflecting panel and to the side tubes, and to selectively fix the length of the adjustable supports.

Figure 3:
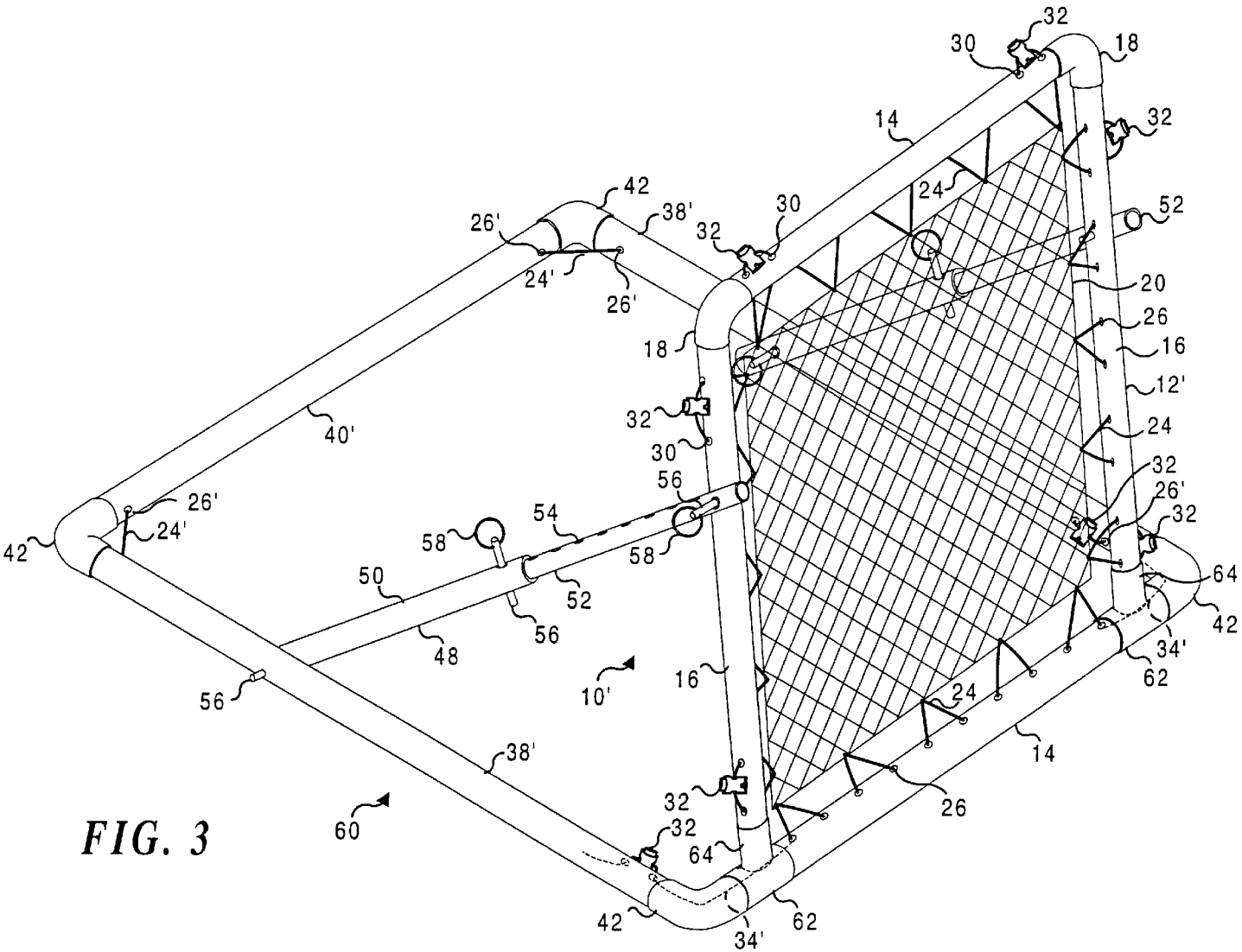
FIG. 3 is an isometric view of a second embodiment of the ball deflecting panel pivotally mounted on a second embodiment of a base.

Referring now to FIG. 3, a second embodiment of a ball deflecting panel 10' is illustrated that is generally identical to ball deflecting panel 10 except for minor differences along its lower side. Ball deflecting panel 10' includes a frame 12' in which vertical tubes 16 are each coupled to a tee 62. Tees 62 include an upwardly extending center 64 into which vertical tubes 16 are inserted. Although a suitable PVC adhesive can be used for coupling the vertical tubes to center 64 of the tee, and for coupling bottom horizontal tube 14 inside tees 62, adhesive should not be used for coupling the tee to adjacent 90° elbows 42. A nipple 66 (shown in FIG. 4, but not in FIG. 3) is used for connecting tees 62 to 90° elbows 42 at the front of a base 60. It is important that ball deflecting panel 10' be pivotally connected to base 60; accordingly, an adhesive can only be used on one side of the nipple connecting tees 62 and 90° elbows 42. Instead of relying solely upon friction for holding elbows 42 onto nipple 66, the embodiment shown in FIG. 3 uses the force exerted by the elastomeric cord that is employed for applying tension to net 20. A portion 34' of each end of the elastomeric cord that applies tensioning force to the lower edge of net 20 extends through the interior of each tee 62 and through the interior of elbow 42 at the front of the base. The tag ends of the elastomeric cord then pass out through orifices 26' in side tubes 38', are gripped by friction clips 32 and then pass back into the interior of side tubes 38'. Thus, the tension force that is applied to net 20 by this section of the elastomeric cord is also used to keep elbows 42 engaged with nipples 66, while allowing pivot movement of the ball deflection panel relative to the base.

In other respects, ball deflecting panel 10' is substantially identical to ball deflecting panel 10, since it includes net 20 supported within a frame 12' using four lengths of elastomeric cord 24. In addition, friction clips 32 are used to maintain the tension applied by the user to elastomeric cords 24 to control the tension of net 20 within frame 12'. The same technique is used for setting the tension of the net to the desired level in ball deflecting panel 10' as described above in connection with ball deflecting panel 10.

Side tubes 38' are connected between 90° elbows 42 disposed at the front and rear of base 60. An end tube 40' extends between the two 90° elbows at the rear of base 60. This embodiment of the present invention also includes adjustable supports 48 comprising outer tubes 50 and telescoping inner tubes 52. Again, the length of the adjustable supports can be adjusted by telescoping the inner tube to a desired position and fixing the inner tube relative to the outer tube using pin 56, which is inserted through a selected one of the orifices 54 in the telescoping inner tube. Pins 56 also couple the upper end of adjustable support 48 to the outer edges along vertical tubes 16 of ball deflecting frame 10' and the bottom ends of the adjustable support along the inner surfaces of side tubes 38'. Again, other types of fasteners can be used instead of pins 56. If PVC adhesive is not used to connect 90° elbows 42 to side tubes 38' and to end tube 40', base 60 can be readily disassembled for transport or storage. It is possible to rely upon friction for maintaining the side tubes, elbows 42, and end tube 40' coupled together, but an alternative approach shown in FIG. 3 employs two short lengths (8–10 inches in length) of elastomeric cord 24' that extends into the interior of side tubes 38' and end tube 40'. The tag ends of elastomeric cord 24' passes through orifices 26' that are disposed near the adjacent ends of side tubes 38' and end tube 40' and is knotted (not shown) in the interior of the tubes under sufficient tension so as to maintain the side tubes and end tube in engagement with elbows 42. However, by exerting sufficient force to overcome the tension applied by elastomeric cord 24', these tubes can readily be disconnected from the elbows, enabling the base to be more readily stored or transported. Typically, the side tubes and end tube will be left coupled together by elastomeric cord 24' when thus disconnected from the elbows.

Figure 4:
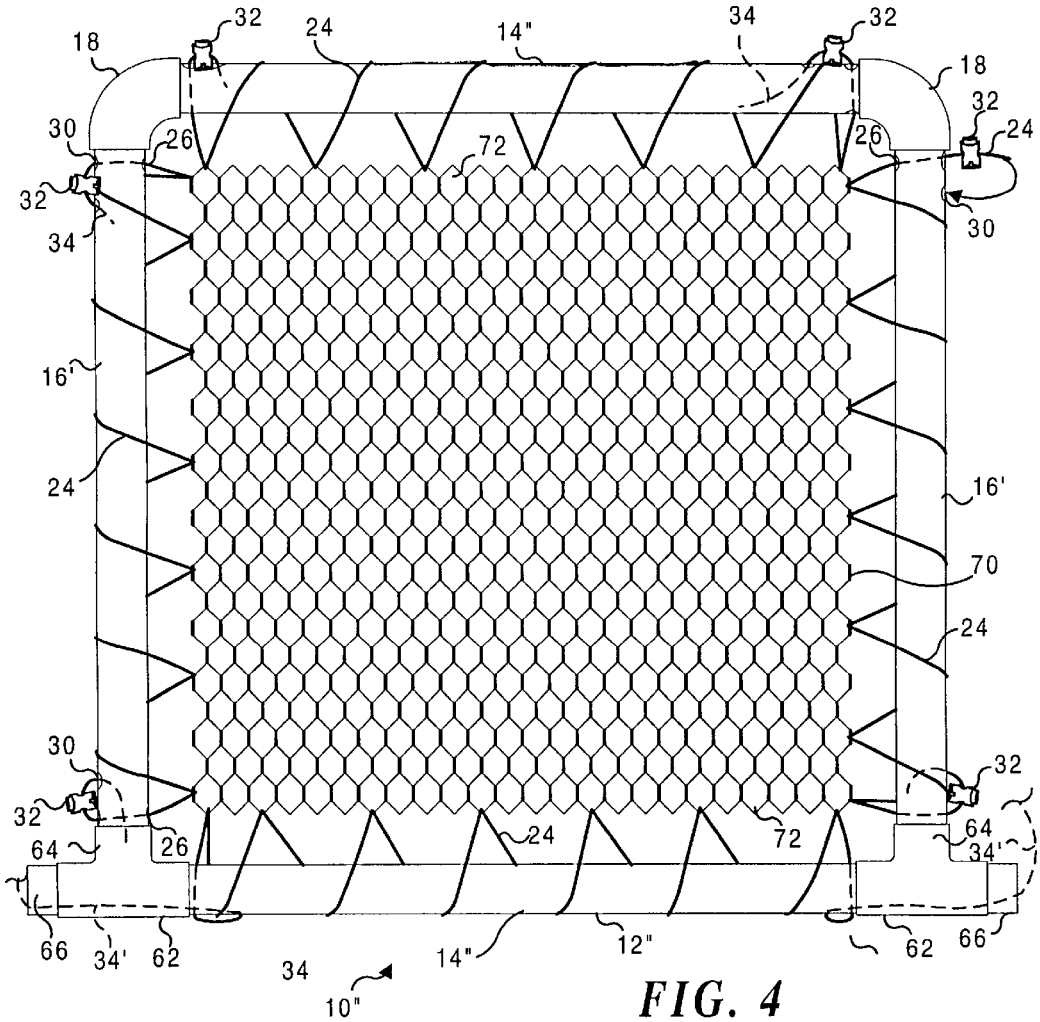
FIG. 4 is an elevational front view of a third embodiment of the ball deflecting panel that includes a net having hexagonal-shaped openings.

Turning now to FIG. 4, a third embodiment of a ball deflecting panel 10" is illustrated. This embodiment includes a frame 12" comprising horizontal tubes 14" and vertical tubes 16'. These tubes are made from PVC tubing, but unlike the corresponding components in the first two embodiments of the ball deflecting panel, have a single orifice 26 disposed adjacent each end, along the inner surfaces of the tubes, instead of a plurality of spaced-apart orifices as in the first two embodiments. FIG. 4 more clearly shows the nipples 66 that are inserted into (but not adhesively connected to both) the 90° elbows 42 at the front of base 60. Ball deflecting panel 10" is intended to be used with and pivotally coupled to base 60, generally in the same manner as ball deflecting panel 10' (as shown in FIG. 3 and described above).

Instead of a net 20, ball deflecting panel 10" includes a net 70 that defines a plurality of hexagonal-shaped openings 72. In addition, net 70 is suspended within frame 12" using sections of elastomeric cord 24 that pass through openings 72 at spaced-apart intervals along the periphery of net 70 and then simply loop around the outer surfaces of horizontal tubes 14" and vertical tubes 16'. Only the ends of elastomeric cords 24 pass through orifices 26 at each end of the horizontal and vertical tubes, pass through the interior of the tubes and out through orifices 30. The tension in elastomeric cords 24 is adjusted by manually pulling outwardly on the tag ends 34 of elastomeric cords 24 to establish the desired tension in net 70 as discussed above in connection with net 20. Once the desired tension is achieved in elastomeric cords 24, friction clips 32 are clamped on the elastomeric cords, preventing the elastomeric cords from pulling back into orifices 30. It will be noted that the fabrication costs and the assembly time required to support net 70 using elastomeric cords 24 that are simply looped around the outer surfaces of horizontal tubes 14" and vertical tubes 16' are substantially less than required to thread the elastomeric cord through the interior of horizontal tubes 14 and vertical tubes 16, as shown in connection with the method used to support ball return panel 10 in ball return panel 10 (FIG. 1). Segments 34' of the elastomeric cord extend through orifices 30 into the interior of tees 62 and out through the orifices in the side tubes of the base (not shown in FIG. 4). The tag ends of the elastomeric cord are clipped with the friction clips after the desired force is manually applied, to hold the net under tension and maintain the tee, nipples, and elbows of the base in coupled pivotal engagement, as discussed above with regard to FIG. 3.

Figure 5:
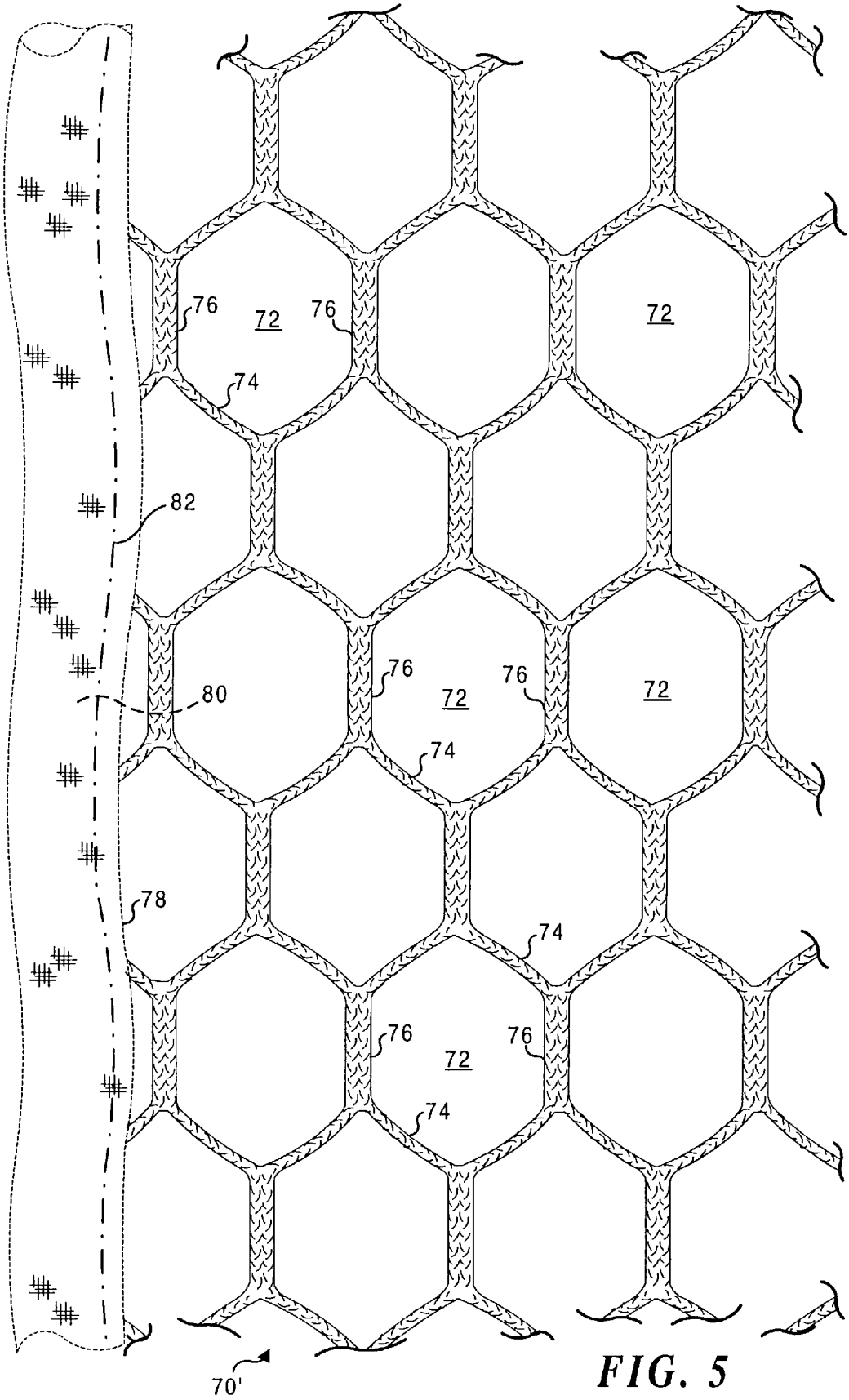
FIG. 5 illustrates details of a section of the net shown in FIG. 4.

FIG. 5 illustrates details of net 70. Net 70 comprises a plurality of knitted plastic strands 74 that are joined together at the sides of each hexagonal-shaped opening 72 to form a double width strand 76. Because the strands are knitted to form the opening and because of the shape and elastomeric properties of hexagonal-shaped openings 72, the hexagonal-shaped openings deform around a ball or other sports projectile striking net 70 in a manner that tends to ensure a consistent deflection of the ball or sports projectile relative to a given angle of incidence. It has been found that the return path of the ball or sports projectile striking net 70 can be consistently predicted relative to the angle at which the ball or sports projectile impacts the net. According to the laws of physics, for a perfectly elastic surface, the angle of incidence of a ball should equal its angle of reflection. For net 20, which has square/diamond-shaped openings 22, the angle of reflection is not as consistently equal to the angle of incidence. Apparently, hexagonal-shaped openings 72 more readily deform uniformly around a ball than the square/diamond-shaped openings. Accordingly, net 70 is more preferred for use in the present invention to achieve consistency in the direction along which a ball is returned from ball deflecting panel 10".

FIG. 5 also illustrates an optional edging 78 that comprises a strip 80 of nylon or other fabric that is folded over the peripheral edge of net 70 and stitched in place along a stitching line 82. A similar edging can be applied to the periphery of net 20, if desired.

Figure 6:
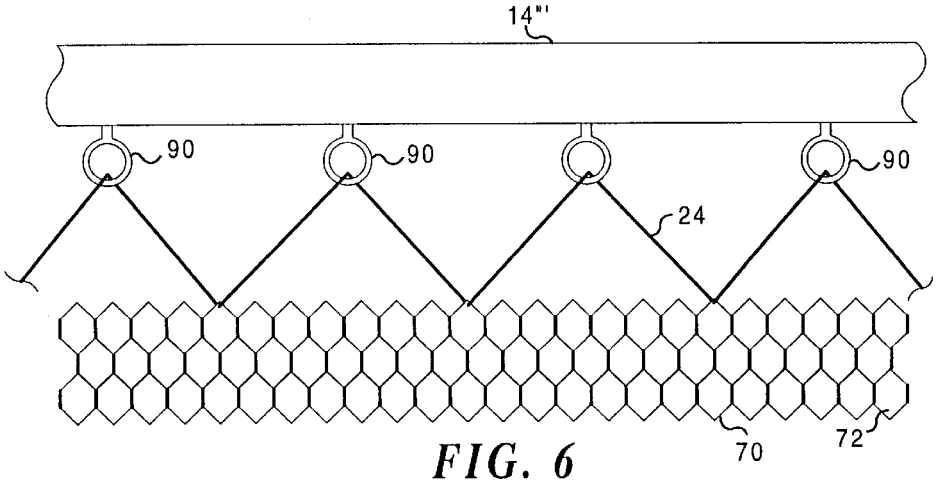
FIG. 6 is a front elevation view of a portion of the top of a fourth embodiment of a ball deflecting panel that uses eyelets to support a net.

Yet another alternative for connecting net 70 (or net 20) to the frame of a ball deflecting panel in connection with the present invention is illustrated in FIG. 6. In this Figure, a plurality of eyelets 90 are threaded or otherwise suitably fastened to a horizontal tube 14'" and to corresponding vertical tubes (not shown) that comprise a frame of a ball deflecting panel. Elastomeric cord 24 is then looped through hexagonal-shaped openings 72 in net 70 (or through square/diamond-shaped openings 22 in net 20) and through eyelets 90, which are disposed at spaced-apart intervals along the inner surface of the tubes comprising the frame of the ball deflecting panel. The elastomeric cord is more readily threaded through the eyelets than through orifices 26 and the interior of the corresponding tubes used in ball deflecting panel 10 (FIG. 1), so that the fabrication costs and time required to support the net within the frame is less than for the first embodiment. However, the eyelets are more expensive and subject to being struck by a ball or other sports projectile.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. Apparatus for deflecting a sports projectile that is traveling along an incident path, back along a return path, comprising:

(a) a frame having a base portion and an elevatable portion;

(b) an elastomeric panel suspended within the elevatable portion by an elastomeric cord that extends between a periphery of the elastomeric panel and the elevatable portion of the frame, said elastomeric cord coupling the elastomeric panel to the elevatable portion of the frame so that the elastomeric panel defines an impact area for the sports projectile as the projectile travels along the incident path; and (c) means for adjusting a tension of the elastomeric panel to enable a user to selectively change a force with which the sports projectile is deflected back along the return path relative to that at which the sports projectile traveling along the incident path strikes the elastomeric panel.

2. The apparatus of claim 1, wherein the elastomeric panel comprises a net having a plurality of hexagonal-shaped openings formed of knitted strands, said hexagonal openings conforming uniformly around the sports projectile when the net is impacted by the sports projectile so that the return path of the sports projectile is consistently predictable relative to the incident path of the sports projectile.

3. The apparatus of claim 1, wherein the frame comprises a plurality of tubing sections, at least some of which are joined by elbow connectors, said elevatable portion of the frame having a generally quadrilateral shape.

4. The apparatus of claim 3, wherein the plurality of tubing sections comprising the elevatable portion include an orifice into which a tag end of the elastomeric cord is inserted to hide any excess length of the elastomeric cord.

5. The apparatus of claim 1, wherein the elevatable portion of the frame is pivotally attached to the base portion and is selectively adjustable by the user by rotating the elevatable portion of the frame to a desired angle relative to the base portion.

6. The apparatus of claim 5, wherein the frame includes a support member that extends between the elevatable portion and the base portion, said support member having a length that is adjustable, the angle of the elevatable portion relative to the base portion being selectively varied as a function of the length to which the support member is adjusted.

7. The apparatus of claim 6, wherein said support member comprises a smaller diameter tube and a larger diameter tube, said smaller diameter tube sliding inside the larger diameter tube, further comprising a set pin that extends through an orifice in at least one of the smaller and larger diameter tubes, to fix the length of the support member.

8. The apparatus of claim 5, wherein a top of the elevatable portion of the frame can be set at a plurality of predefined angles relative to a horizontal plane, said plurality of predefined angles ranging between a first position in which the top is closer to the user than a bottom of the elevatable portion of the frame, and a second position in which the bottom of the elevatable portion of the frame is closer to the user than the top.

9. The apparatus of claim 1, wherein the elevatable portion of the frame includes a plurality of orifices through which the elastomeric cord is threaded to couple the elastomeric cord to the elevatable portion of the frame.

10. The apparatus of claim 1, wherein the means for adjusting the tension of the elastomeric panel comprise means for selectively changing a tension in the elastomeric cord.

11. The apparatus of claim 10, further comprising a clip that is releasably attached to the elastomeric cord to maintain said cord at a desired tension.

12. The apparatus of claim 1, wherein the elevatable portion of the frame includes a plurality of eyelets attached to the frame at spaced-apart intervals, said elastomeric cord being threaded through the plurality of eyelets to couple the elastomeric cord to the elevatable portion of the frame.

13. The apparatus of claim 1, wherein the elastomeric cord is repetitively looped around the elevatable portion of the frame to couple the elastomeric cord thereto.

14. The apparatus of claim 1, wherein ends of the elastomeric cord are drawn tight under tension and at least one end of the elastomeric cord is fastened in a clip to apply a desired tension to the elastomeric panel.

15. The apparatus of claim 1, wherein the frame comprises a plurality of tubular sections joined by a plurality of elbows.

16. Apparatus for deflecting a sports projectile that is traveling along an incident path, back along a return path, said return path lying in a direction that is consistently predictable relative to the incident path of the sports projectile, comprising:

(a) a frame having a base portion and an elevatable portion; and (b) a net comprising a plurality of strands that define a plurality of hexagonal-shaped openings, said net being suspended within the elevatable portion by an elastomeric cord that extends between a periphery of the elastomeric panel and the elevatable portion of the frame, said plurality of hexagonal-shaped openings deforming around the sports projectile so as to ensure that the net consistently deflects the sports projectile back along the return path at a predictable angle relative to the incident path along which the sports projectile is traveling when it strikes the net.

17. Apparatus for deflecting a sports projectile that is traveling along an incident path, generally back along a return path, comprising:

(a) a frame having a base portion and an elevatable portion;

(b) an elastomeric panel suspended within the elevatable portion by an elastomeric cord that extends between a periphery of the elastomeric panel and the frame, said elastomeric cord coupling the elastomeric panel to the elevatable portion of the frame so that the elastomeric panel defines an impact area for the sports projectile as the projectile travels along the incident path; and (c) a support member that extends between the base portion of the frame and the elevatable portion of the frame, said support member having a length that is adjustable to enable a user to selectively set an angle of the elevatable portion of the frame relative to the base portion and thereby determine the return path of the sports projectile relative to the incident path.

18. The apparatus of claim 17, further comprising means for enabling the user to selectively set a tension of the elastomeric panel so that a force with which the sports projectile is deflected is changed relative to that with which the sports projectile impacts the elastomeric panel.

19. The apparatus of claim 17, further comprising another support member, each support member being connected to a different side of the elevatable portion of the frame and extending to a corresponding different side of the base, so that the support members are connected to opposite sides of the base.

20. The apparatus of claim 17, wherein the support member comprises a smaller diameter tube and a larger diameter tube, said smaller diameter tube sliding inside the larger diameter tube, further comprising a pin that extends through an orifice formed in at least one of the smaller and larger diameter tubes, to selectively fix the length of the support member.

21. The apparatus of claim 17, wherein a top of the elevatable portion of the frame is adjustably fixed at a plurality of predefined angles relative to a horizontal plane, said plurality of angles ranging between a first angle at which the top is closer to the user than a bottom of the elevatable portion of the frame, and a second angle at which the bottom of the elevatable portion of the frame is closer to the user than the top.

22. The apparatus of claim 17, wherein the elevatable portion of the frame includes a plurality of orifices through which the elastomeric cord is threaded to couple the elastomeric cord to the elevatable portion of the frame.

23. The apparatus of claim 17, wherein the elevatable portion of the frame includes a plurality of eyelets attached to the frame at spaced-apart intervals, said elastomeric cord being threaded through the plurality of eyelets to couple the elastomeric panel to the elevatable portion of the frame.

24. The apparatus of claim 17, wherein the elastomeric cord is repetitively looped around the elevatable portion of the frame to couple the elastomeric panel thereto.

25. The apparatus of claim 17, wherein the frame comprises a plurality of tubular sections joined by a plurality of elbows.

* * * * *